US006092398A

United States Patent [19]

Matsuda

[11] Patent Number: 6,092,398

[45] Date of Patent: Jul. 25, 2000

[54] DRIVING MECHANISM OF COMPOUND KNITTING NEEDLE IN NARROW WIDTH CROCHET KNITTING MACHINE

[75] Inventor: Yasuhiko Matsuda, Toyama-ken, Japan

[73] Assignee: YKK Corporation, Tokyo, Japan

[21] Appl. No.: 09/419,022

[22] Filed: Oct. 15, 1999

[30] Foreign Application Priority Data

Nov. 16, 1998 [JP] Japan ..... 10-325194

[51] Int. Cl.[7] ..... D04B 27/08

[52] U.S. Cl. ..... 66/208; 66/203

[58] Field of Search ..... 66/82 R, 84 R, 66/85 R, 203, 204, 207, 208, 82 A, 120

[56] References Cited

U.S. PATENT DOCUMENTS

| | | | |
|---|---|---|---|
| 3,681,944 | 8/1972 | Peschl et al. | 66/203 |
| 4,895,006 | 1/1990 | Speich | 66/203 |
| 4,918,947 | 4/1990 | Speich | 66/203 |
| 5,042,273 | 8/1991 | Luigi | 66/203 |
| 5,520,023 | 5/1996 | Kemper | 66/203 |

*Primary Examiner*—Danny Worrell
*Attorney, Agent, or Firm*—Hill & Simpson

[57] ABSTRACT

There is provided a driving mechanism of a compound knitting needle in a narrow width crochet knitting machine, which can highly accurately control an operation timing and stroke of a compound knitting needle comprising a hook-like knitting needle and a needle-like slider even in an operation at a speed higher than a conventional case without generating jumping or an error in its operation. A needle bar driving mechanism reciprocates a needle bar fixing and supporting base end portions of the plurality of hook-like knitting needles via a first rod at a desired timing, and comprises a rotary member supported on a main rotary shaft, and a first rod having one end rotatably attached to the needle bar and the other end rotatably attached onto a position which is eccentric from the rotary axis of the rotary member. A slider bar driving mechanism reciprocates a slider bar fixing and supporting base end portions of the plurality of sliders via a second rod at a desired timing, and comprises a rotary cam supported on the main rotary shaft, and the second rod (21) having one end having a cam follower and the other end rotatably attached to the slider bar.

5 Claims, 7 Drawing Sheets

DRIVING MECHANISM OF COMPOUND KNITTING NEEDLE IN NARROW WIDTH CROCHET KNITTING MACHINE

BACKGROUND OF THE INVENTION

1. Field of the Invention

The present invention relates to a driving mechanism for a narrow width crochet knitting machine which is a narrow width warp knitting machine including a compound knitting needle composed of a combination of a hook-like knitting needle and a slider for opening/closing a hook opening of the hook-like knitting needle, and a guide needle for a warp knitting yarn and a weft in-laid yarn. Particularly, it relates to a driving mechanism for controlling an operating timing and stroke of the hook-like knitting needle and the slider. More particularly, the present invention relates to a driving mechanism of a narrow width crochet knitting machine, which can relatively operate the hook-like knitting needle and the slider at a proper timing and stroke without shakiness, and can form various knitted loops at a high speed.

2. Description of the Related Art

Conventionally, in this type of warp knitting machine, with the aforesaid high speed, a Karabiner needle which is one of so-called "beard needle" has been used, as disclosed in U.S. Pat. No. 4,417,455. This knitting needle merely form a knitted loop from one direction, and a weft in-laid yarn is not caught by the knitting needle even in a high speed; and thus, proper weft insertion can be carried out. However, in general, the knitting needle can not form an open loop, and forms only closed loop. For this reason, since various knitted loops are required in recent years, it is difficult to form various knitted loops by using the general crochet knitting machine. As a result, there are many cases of using a "compound knitting needle" comprising a hook-like knitting needle and a needle-like slider for opening and closing an opening of the hook-like knitting needle in place of the aforesaid knitting needle.

By the way, a knitting mechanism by the above compound knitting needle is as shown in FIG. 7(A) to FIG. 7(D). First, a hook-like knitting needle 1 hooks a warp knitting yarn 2, and then, with a needle-like slider 3 closing a hook opening 1*a* of the hook-like knitting needle 1, both the slider 3 and the knitting needle 1 are retracted to the most retracting position on a needle bed fixed on a machine frame (not shown) (see FIG. 7(A)), and thereafter, the hook-like knitting needle 1 independently advances as the slider 3 is not moved (see FIG. 7(B)). In order to form a next knitted loop on the most advancing position, the warp knitting yarn 2 runs over the hook opening 1*a* of the hook-like knitting needle 1 by a swinging operation of a warp knitting yarn guide needle 4, and then, is hooked on the hook-like knitting needle 1 (see FIG. 7(C)).

At this time, the slider 3 is advanced, and then, closes the hook opening 1*a* of the hook-like knitting needle 1 so that the warp knitting yarn 2 is not released from the hook opening 1*a* (see FIG. 7(D) ). When closing by the slider is completed, the hook-like knitting needle 1 and the slider 3 begin to retract together, and then, are returned to the position as shown in FIG. 7(A).

The plurality of hook-like knitting needles 1 and sliders 3 are individually repeatedly operated at the aforesaid timing, and then, knitted loops are successively formed, and thus, a desired warp knitted fabric is knitted. In the crochet knitting machine, a plurality of weft in-laid yarn guide bars (not shown) are arranged longitudinally above a tip end of the warp knitting yarn guide needle 4. Each weft in-laid yarn guide bar is transversely reciprocated, and then, a plurality of weft in-laid yarn guide needles (not shown) attached to the weft in-laid yarn guide bar are transversely reciprocated, and thus, many weft in-laid yarns (not shown) are successively inserted into a predetermined warp knitted loop.

As described above, in the knitting mechanism of the compound knitting needle in this type of narrow width crochet knitting machine, it is very important that the hook-like knitting needle and the slider are operated at a proper timing. Unless the hook-like knitting needle and the slider are operated within a range of proper reciprocating stroke, loop skipping is much generated, or an unnecessary weft insertion to a knitted loop is made; as a result, it is impossible to carry out desired knitting. In particular, the aforesaid problem frequently arises as the machine is run in high speed.

In order to solve the above problem, a driving mechanism of a compound knitting needle, which is adaptable to a high speed in some degree, has been developed. For example, European Patent Publication No. 0302209A1 discloses a driving mechanism of a compound knitting needle, in which the driving mechanism operates as follows. As shown in FIG. 4, the plural hook-like knitting needles 1 are fixed to a needle bar 7 at their rear ends, and the plural needle-like sliders 3 are fixed to a slider bar 8 at their rear ends, and the needle bar 7 and the slider bar 8 are disposed independently from each other so as to be reciprocated. The needle bar 7 and the slider bar 8 are fixed to a front end of each of two rods 7*a* and 8*a*. On the other hand, two rotary plane cams 9*a* and 9*b* are attached to a main rotary shaft as being arranged in parallel, and further, rolling elements 7*b* and 8*b* attached to the rear ends of rods 7*a* and 8*a* are elastically abutted against respective cam surfaces of the two rotary plane cams 9*a* and 9*b*.

In the driving mechanism of the compound knitting needle, when a main shaft is rotated, the rotary plane cams 9*a* and 9*b* are rotated, and then, the rolling elements 7*b* and 8*b* elastically abutted against respective cams 9*a* and 9*b* follow, and thus, the rods 7*a* and 8*a*, that is, the needle bar 7 and the slider bar 8 are reciprocated at a timing and stroke independently from each other. The timing and stroke of reciprocation at this time are determined by a cam curve of respective rotary plane cams 9*a* and 9*b*.

For example, Japanese Patent Publication No. 4-44025 discloses another driving mechanism of the above (compound knitting needle. In this driving mechanism, as shown in FIG. 5, the needle bar 7 and the slider bar 8 are reciprocated via a link mechanism at a predetermined timing and stroke. More specifically, the needle bar 7 is reciprocated by a first crank pin 71 which is located on an eccentric position of a rotating disc rotating when the main rotary shaft is rotated, via a first link 72. On the other hand, respective one ends of second and third links 83 and 84 are supported on crank pins 81 and 82 of second and third rotating discs rotating when the main rotary shaft is rotated, and the other ends of second and third links 83 and 84 are connected by means of a fourth link 85. The rod 8*a* fixed to the slider bar 8 at its front end is rotatably supported at its rear end on the central point of the fourth link 85, and a combined operation of the second and third links 83 and 84 by the rotation of the second and third crank pins 81 and 82 rotating synchronously with a rotation of the main rotary shaft, is converted into a reciprocation of the rod 8*a* via the fourth link 85. Thus, the needle-like slider bar 8 is reciprocated at the predetermined timing and stroke as described above.

These driving mechanisms individually have merits and demerits. For example, in the case of determining the above operation timing and stroke of the needle bar and the slider bar by the rotary plane cam, it is possible to carry out a control with a high accuracy by setting an ideal cam curve. However, when a speed is high, for example, it exceeds 1200 r.p.m., the rolling element, which is a cam driven element, can not follow a rotation of cam; for this reason, wear between contacting members or jumping is frequently generated. As a result, even if cam surface machining having an ideal cam curve is made, the timing is shifted in the operation between the hook-like knitting needle and the slider, or their operation become irregular, and loop skipping is generated. Therefore, it is impossible to obtain a desired knitted tape.

Meanwhile, according to the aforesaid driving mechanism by combining a crank and a link, the mechanism has almost no shakiness on its mechanism, and is adaptable to a high speed as compared with the driving mechanism using the rotary plane cam. Moreover, a reciprocating operation of the hook-like knitting needle is a sine curve of 360°, and its acceleration and stroke are determined solely by an arm length of the first crank and a link length; therefore, it is possible to readily set the operation timing and stroke. On the other hand, a reciprocating operation of the slider is based on a combined operation of the second and third cranks and second to fourth links. Thus, their acceleration and stroke are variously modified by an arm length of the second and third crank, a phase difference between the second and third crank pins, each length of the second to fourth links. However, there are many factors of giving an influence to the operation timing and stroke, and the structure is complicated; for this reason, it is difficult to set a highly accurate motion curve.

The following problem arises in either case of the above driving mechanisms. Particularly, with this type of narrow width crochet knitting machine, for example, in the case of manufacturing a slide fastener stringer continuously in which an engaging element made of a monofilament is knitted continuously in a tape at the time of knitting the tape, and thus, in addition to the above knitting timing, there is a need of knitting a thick monofilament by weft insertion; for this reason, the aforesaid operation timing and stroke of the compound knitting needle must be further strictly controlled. Therefore, it is impossible to manufacture the above stringer at a high speed.

SUMMARY OF THE INVENTION

The present invention has been made in order to solve the aforesaid problem in the prior art. It is, therefore, an object of the present invention to provide a driving mechanism of a compound knitting needle in a narrow width crochet knitting machine, which can highly accurately control an operation timing and stroke of a compound knitting needle comprising a hook-like knitting needle and a needle-like slider in operation at a speed higher than a conventional case without generating jumping or an error in its operation.

The invention provides a driving mechanism of a compound knitting needle in a narrow width crochet knitting machine, including: a needle bar driving mechanism having a compound knitting needle which is composed of a plurality of hook-like knitting needles reciprocating on a needle bed, and a slider which slides in a longitudinal direction on each knitting needle and opens/closes a hook opening of the knitting needle, and reciprocating a needle bar fixing and supporting base end portions of the plurality of hook-like knitting needles via a first rod at a desired timing; and a slider bar driving mechanism reciprocating a slider bar fixing and supporting base end portions of the plurality of sliders via a second rod at a desired timing. The needle bar driving mechanism includes a rotary member supported on a main rotary shaft, and the first rod having one end rotatably attached to the needle bar and the other end rotatably attached onto a position which is eccentric from the rotary axis of the rotary member. And the slider bar includes a rotary cam supported on the main rotary shaft and the second rod having one end having a cam follower and the other end rotatably attached to the slider bar.

According to the present invention, it is possible to control a timing and stroke of the reciprocating operation of the hook-like knitting needle by a so-called reciprocating slider link row combining a crank and link, and to control a timing and stroke of the reciprocating operation of the slider bar by the cam.

In the timing and stroke of the reciprocating operation of the hook-like knitting needle, the aforesaid reciprocating slider link row is used so that the hook-like knitting needle can be most smoothly operated even in high speed operation, and the timing and stroke of the reciprocating operation of the slider is realized by the rotary cam enabling an ideal curve motion. Further, in the present invention, a special structure may be employed as a follower including a cam follower, which will be described later, in order to meet a request of high speed operation. However, without employing the special structure as the follower, it is possible to sufficiently meet an operation at a speed higher than the conventional case even if the rotary cam is used, by setting the stroke of the reciprocating operation of the slider to be small as much as possible, that is, setting the reciprocating operation of the slider to be small as much as possible, and by setting a cam curve of the rotary cam in such a manner that the timing and stroke of a part of sine curve motion of the above described slider and those of the hook-like knitting needle by the above reciprocating slider link row become identical.

Preferably, the rotary cam has a cam wall portion which is formed with an inner circumferential cam surface and an outer circumferential cam surface, and the cam follower comprises a pair of rolling elements which are abutted against the cam wall portion so as to hold it between these rolling elements. Alternatively, the rotary cam has a cam groove which is formed with an inner circumferential cam surface and an outer circumferential cam surface, and the cam follower includes a single rolling element, a so-called positive motion cam, which rolls so as to be abutted against the inner and outer circumferential cam surfaces of the cam groove.

Further preferably, a support member of the rolling element has a shock absorber mechanism for absorbing a clearance between the rolling element and the inner and outer circumferential cam surfaces of the cam wall portion or those of the cam groove. This shock absorber mechanism can always realize a smooth reciprocating motion of the slider by the rotary cam without shakiness even when the rotary cam is rotated at a high speed.

DETAILED DESCRIPTION OF THE PREFERRED EMBODIMENTS

Preferred embodiments of the present invention will be described below with reference to the accompanying drawings.

Figure 1:
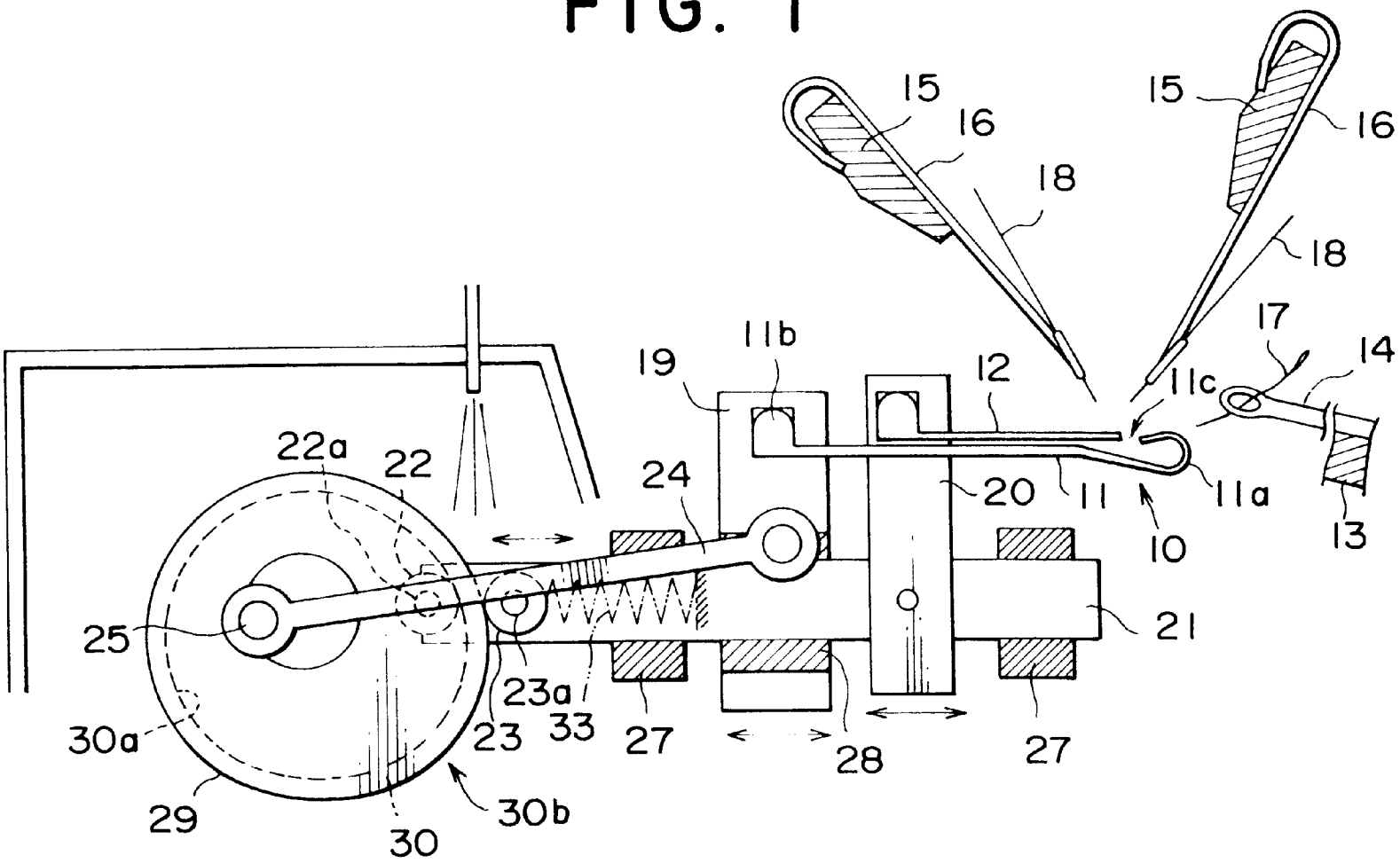
FIG. 1 is a side view schematically showing a driving mechanism of a typical compound knitting needle in a narrow width crochet knitting machine according to one embodiment of the present invention.

FIG. 1 schematically shows the most preferable driving mechanism of a compound knitting needle in a crochet knitting machine according to the present invention. The present invention is not limited to the illustrated example.

In FIG. 1, a compound knitting needle 10 is composed of a hook-like knitting needle 11 and a needle-like slider 12. The hook-like knitting needle 11 is normally formed with a sliding groove (not shown) on which the needle-like slider 12 slides, in the upper surface thereof.

In a general knitting machine of this type of narrow width crochet knitting machine, as shown in FIG. 1, the compound knitting needle 10 is cooperated with a plurality of needle-like warp guides 14 which are supported by a warp guide bar 13 arranged ahead of the compound knitting needle 10 and vertically and horizontally swingable, and with a plurality of tubular in-laid yarn guides 16 which are supported on a plurality of weft guide bars 15 arranged above a tip end of the compound knitting needle 10 and are horizontally reciprocated. The warp guide 14 guides a warp knitting yarn 17, while the in-laid yarn guide 16 guides a weft in-laid yarn 18.

The hook-like knitting needle 11 and the needle-like slider 12 of the compound knitting needle 10 are horizontally reciprocated independently from each other at a predetermined timing between the former and the latter. The present invention provides a novel and effective driving mechanism for giving a reciprocating motion to the hook-like knitting needle 11 and the needle-like slider 12 of the compound knitting needle 10. The hook-like knitting needle 11 has a hook portion 11*a* for forming a knitted loop at the tip end thereof, and an engaging portion 11*b* with respect to a needle bar 19 which will be described later, at the rear end thereof. On the other hand, the needle-like slider 12 has a shape of needle having a tip end formed into a taper surface at the distal end thereof and an engaging portion with respect to a slider bar 20 which will be described later, at the rear end thereof. Further, the needle-like slider 12 is slidable in a longitudinal direction along a sliding groove (not shown) on the hook-like knitting needle 11 so as to open/close an opening 11*c* of the hook portion 11*a*, and holds a knitted loop on the hook portion 11*a*, or releases it from the hook portion 11*a*.

Figure 2:
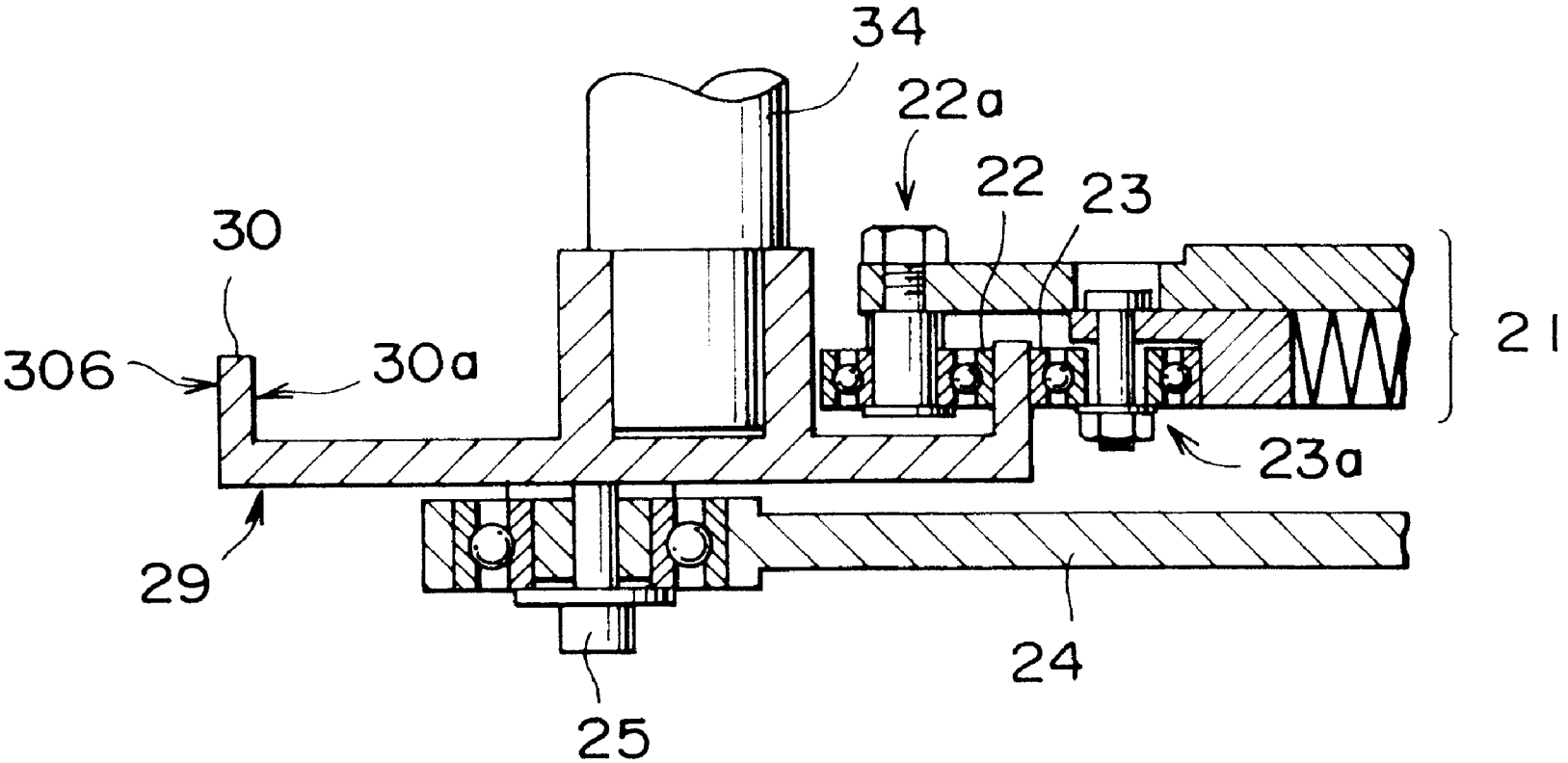
FIG. 2 is a top plan view showing the driving mechanism of the compound knitting needle.

The needle bar 19 and the slider bar 20 are located on a front and rear sides in a knitting section and are arranged right and left, and further, are provided with a driving mechanism of compound knitting needle according to the present invention at their one end. According to this embodiment, as shown in FIG. 1 and FIG. 2, the needle bar 19 is arranged on a rear side of the slider bar 20. A front end portion of a second rod 21 horizontally extending is attached to the slider bar 20, and two rolling elements 22 and 23 which serve as cam followers are rotatably supported at the rear end of the second rod 21 so as to freely roll, and have a rolling axis on the rod axis. On the other hand, a distal end of a link 24 which is a first rod, is rotatably attached to the needle bar 19, and a rear end of the link 24 is rotatably attached to a crank pin 25.

Front and rear ends of the second rod 21 fixed to the slider bar 20 are horizontally slidably supported on support members fixed on machine bases (not shown) via thrust bearings 27. On the other hand, the needle bar 19 is guided by the second rod 21, and is longitudinally slidably supported via a thrust bearing 28.

The crank pin 25 is attached to a rotatably driven main shaft, and is situated on an eccentric position which is separated a predetermined distance from a rotating axis of a rotary disc 29 serving as a rotary member rotating along the rotation of the main shaft. When the crank pin 25 is rotated, the needle bar 19 is horizontally reciprocated along the second rod 21. At this time, a motion of the needle bar 19, that is, the hook-like knitting needle 11 is made along a sine curve, and the reciprocating stroke is determined by a distance between the crank pin 25 and the rotating axis of the rotating disc 29.

Inner and outer cam surfaces 30*a* and 30*b* are formed in a cam wall portion 30 formed on the surface on a side opposite to a side where the crank pin 25 of the rotating disc 29 is projected, and the pair of rolling elements 22 and 23 are rotatably supported on the rear end of the second rod 21 so as to freely roll. The pair of rolling elements 22 and 23 are abutted against the inner and outer cam surfaces 30*a* and 30*b*, so that when the cam wall portion 30 is rotated, the slider bar 20 is reciprocated via the second rod 21.

In the general rotary plane cam, a follower car not follow a rotation along the cam surface when the rotational speed becomes high; for this reason, a motion pursuant to a desired cam curve can not be realized. On the contrary, the cam wall portion 30 of this embodiment has a ring shape formed along the circumferential edge of the rotating disc 29, and is formed with conjugate cam surfaces 30*a* and 30*b* on its inner and outer wall surfaces, and thereby, the cam wall portion 30 is set so as to be held between the above rolling elements 22 and 23. More specifically, in the present invention, a positive motion cam structure is employed as the rotary cam. Thus, even when the knitting machine is operated at a high speed more than usual, the pair of rolling elements 22 and 23 roll while being always abutted against the inner and outer cam surfaces 30*a* and 30*b*, and thereby, it is possible to smoothly reciprocate the slider bar 20, that is, the slider 12 via the second rod 21 at a predetermined timing and stroke without jumping.

Figure 3:
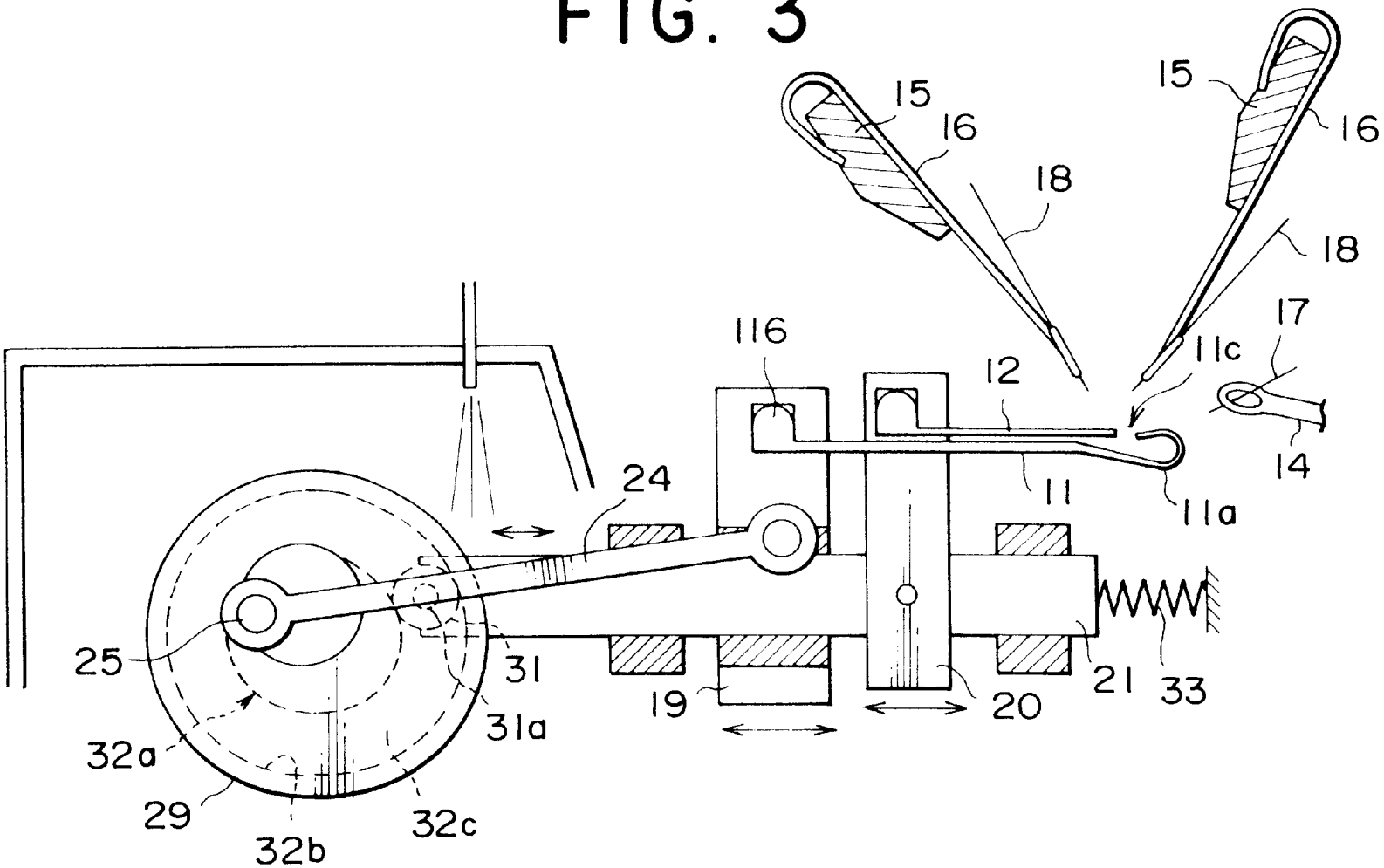
FIG. 3 is a side view schematically showing a driving mechanism of a compound knitting needle according to another embodiment of the present invention.
Figure 4:
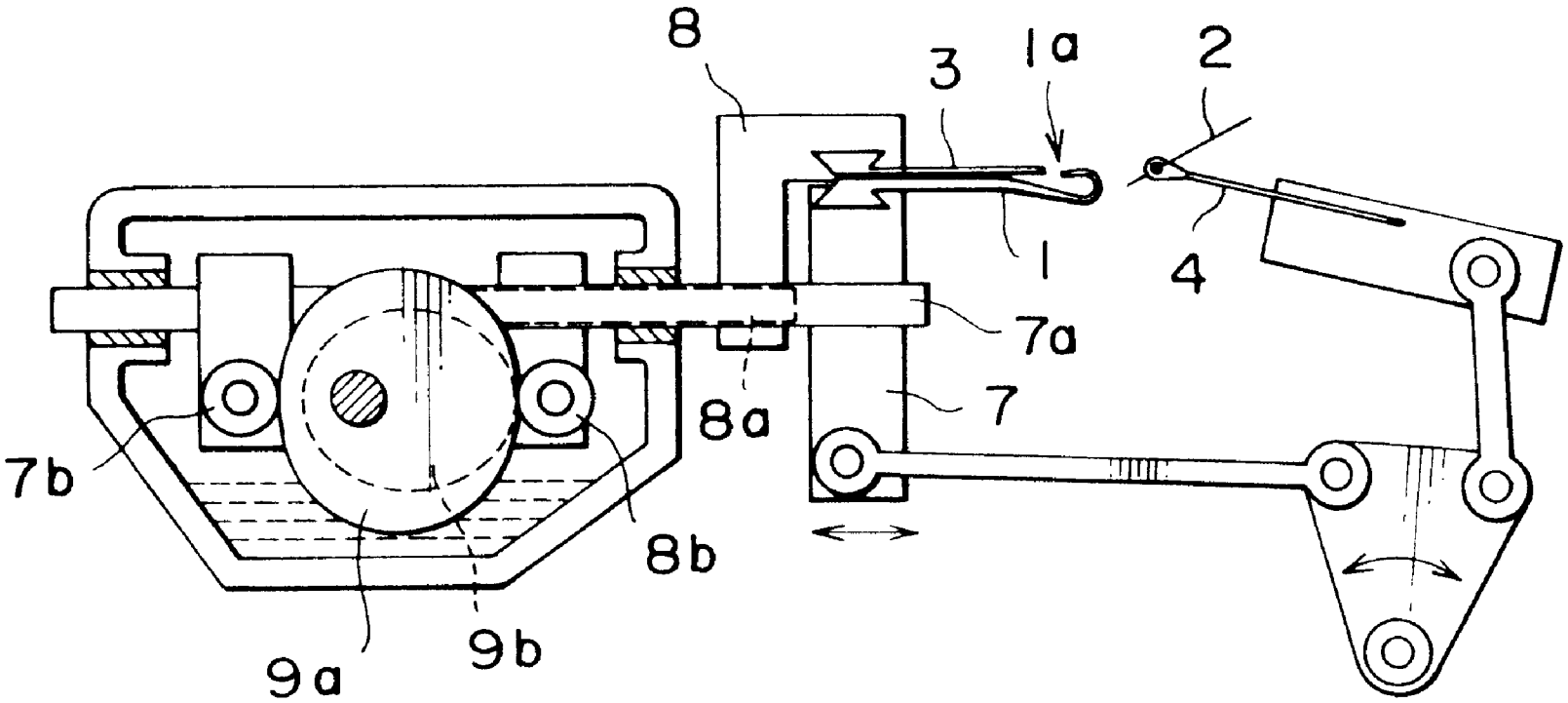
FIG. 4 PRIOR ART
FIG. 4 is a side view schematically showing a conventional driving mechanism of a compound knitting needle by a rotating cam.
Figure 5:
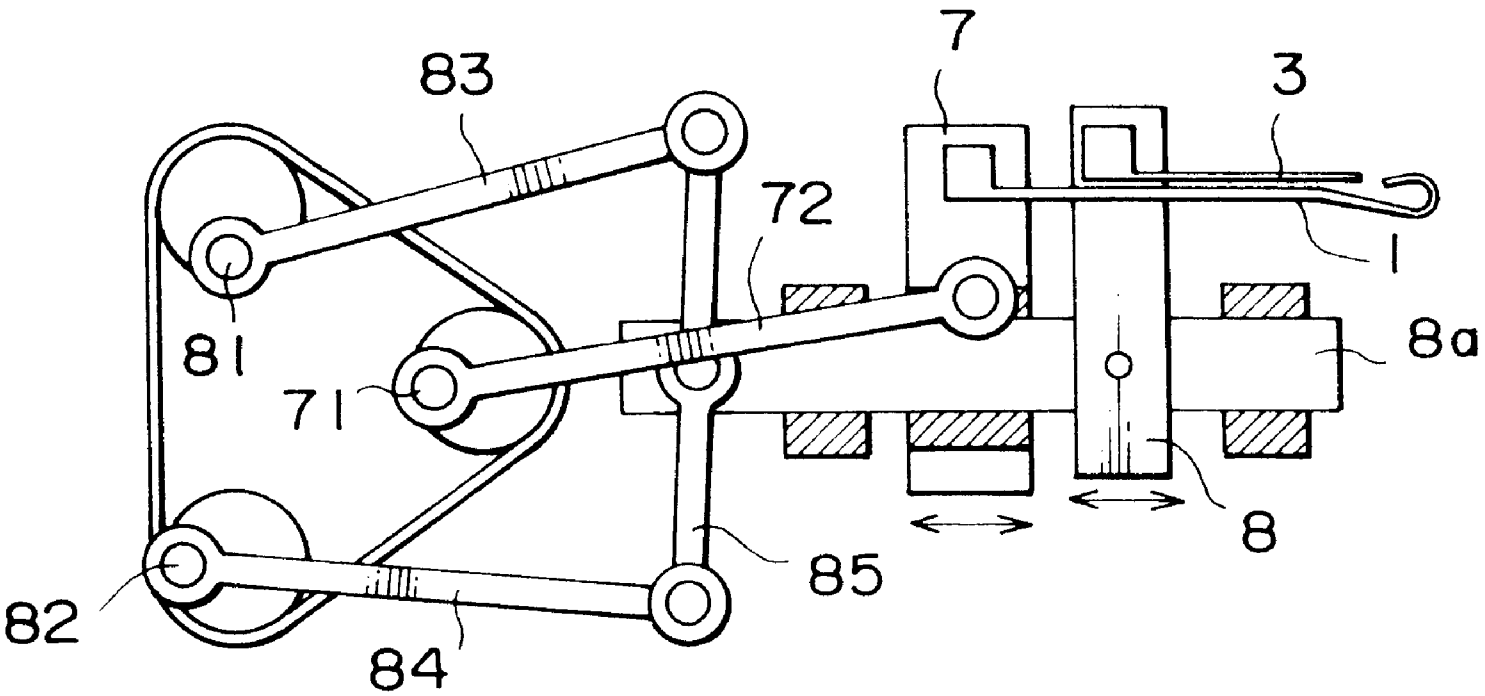
FIG. 5 PRIOR ART
FIG. 5 is a side view schematically showing a conventional driving mechanism of a compound knitting needle by means of a combination of a crank and a multi-link row.

FIG. 3 shows a driving mechanism of the slider bar 20 according to another embodiment of the invention, and the following positive motion cam structure is employed. More specifically, a single rolling element 31 serving as a cam follower is rotatably supported on the rear end of the second rod 21. In place of the rotating disc 29 having the cam wall portion 30, a rotary flat disc 32 having the crank pin 25 on one surface is provided with a ring-like cam groove. 32*c* having conjugate cam surfaces 32*a* and 32*b* as inner and outer circumferential surfaces in the circumferential edge on the other surface of the disc 32. The rotating axis of the disc 32 is attached to a main shaft (not shown), and the single rolling element 31 is fitted into the cam groove 32*c*. According to this embodiment, the rolling element 31 securely follows the rotation of the rotary flat disc 32 even when rotating at a high speed, and the slider bar 20 is operated pursuant to a predetermined motion curve.

Moreover, in the embodiments shown in FIG. 1 to FIG. 3, among support members 22*a*, 23*a* and 31*a* of the rolling elements 22, 23 and 31, support members 23*a* and 31*a* are slightly movable in the axial direction of the second rod 21. A shock absorber 33 is provided in order to absorb a motion when the support members 23*a* and 31*a* is slightly moved with respect to the second rod 21. The shock absorber 33 may be a metallic spring, or may be made of other elastic members such as a rubber or the like.

The aforesaid shock absorber 33 is interposed, and thereby, it is possible to avoid a non-contact state of the inner and outer cam surfaces 30*a*, 30*b*; 32*a*, 32*b* with the rolling elements 22, 23 and 31, due to a clearance between the inner and outer cam surfaces 30*a*, 30*b* and the rolling elements 22 and 23, or a clearance between the cam groove 32*c* and the rolling element 31. Thus, even when the machine is operated at a high speed, the second rod 21 is securely reciprocated in accordance with the rotation of the rotary cams 30 and 32 without separating from the inner and outer cam surfaces 30*a*, 30*b*; 32*a*, 32*b*. Further, the shock absorber 33 serves to reduce a load by a friction applied to the inner and outer cam surfaces 30*a*, 30*b*; 32*a*, 32*b* and the second rod 21, and to reduce a wearing between members while securing a smooth operation.

Therefore, according to the driving mechanism of the compound knitting needle 10 having the aforesaid construction in the narrow width crochet knitting machine, thus hook-like knitting needle 11 and the needle-like slider 12 can be operated at a high speed with a desired timing and stroke.

In this type of narrow width crochet knitting machine, it is strongly desired to form various knitted structures. In particular, in addition to a general structure, for example, in the case of knitting a monofilament having a diameter larger than the general knitting yarn, there is an influence due to an increase of the number of yarns, and it is difficult to securely hook the knitting yarn on the hook portion of the knitting needle at a good timing. In order to solve these problems, the hook-like knitting needle 11 and the needle-like slider 12 need to be operated at a high speed with a desired timing and stroke, as described above.

Figure 6:
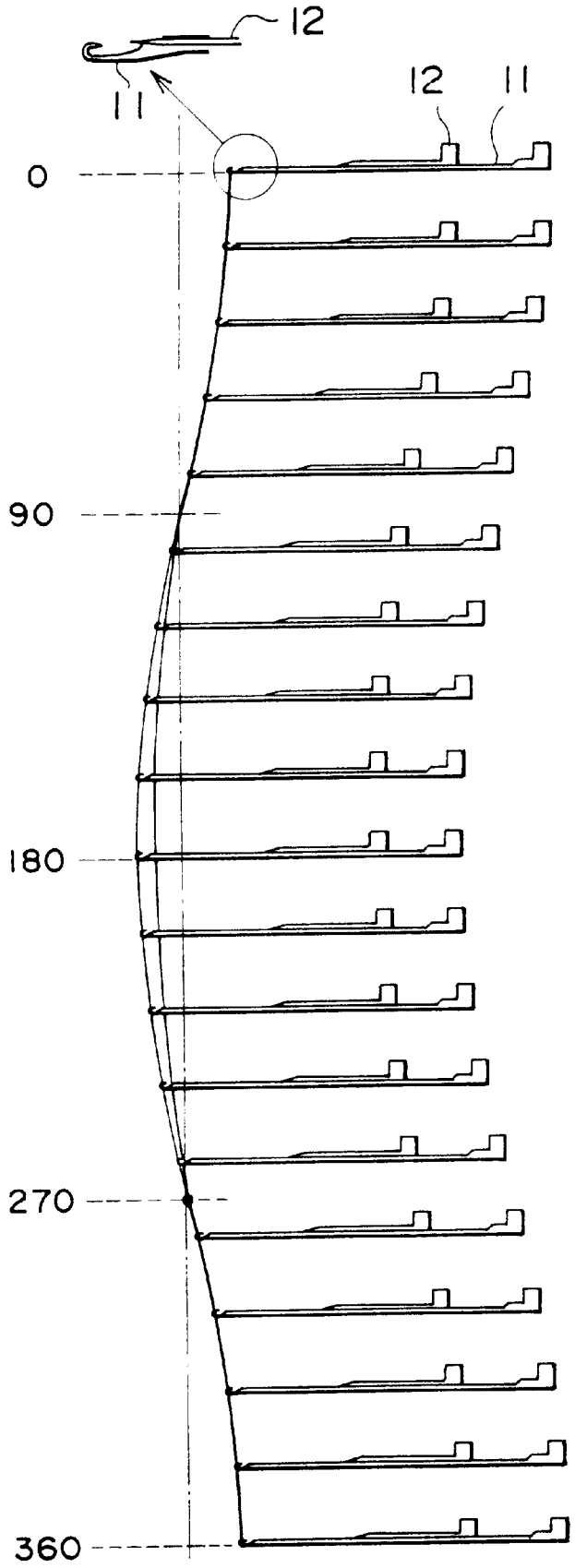
FIG. 6 is an operative curve chart showing a motion curve of the compound knitting needle operated by the driving mechanism of the present invention.
Figure 7A:
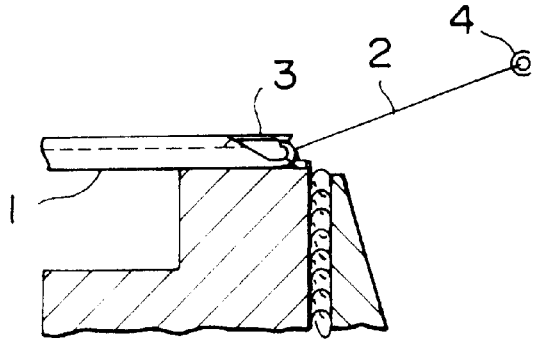
FIG. 7A PRIOR ART
FIG. 7 is a view to explain a general knitting procedure by a narrow width crochet knitting machine.
Figure 7B:
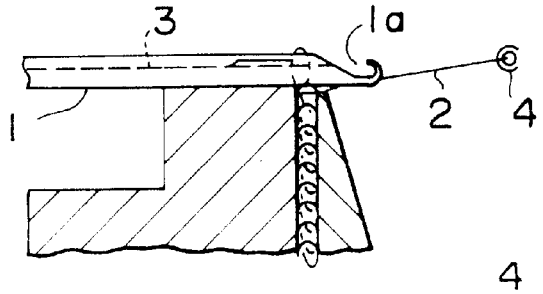
FIG. 7B PRIOR ART
Figure 7C:
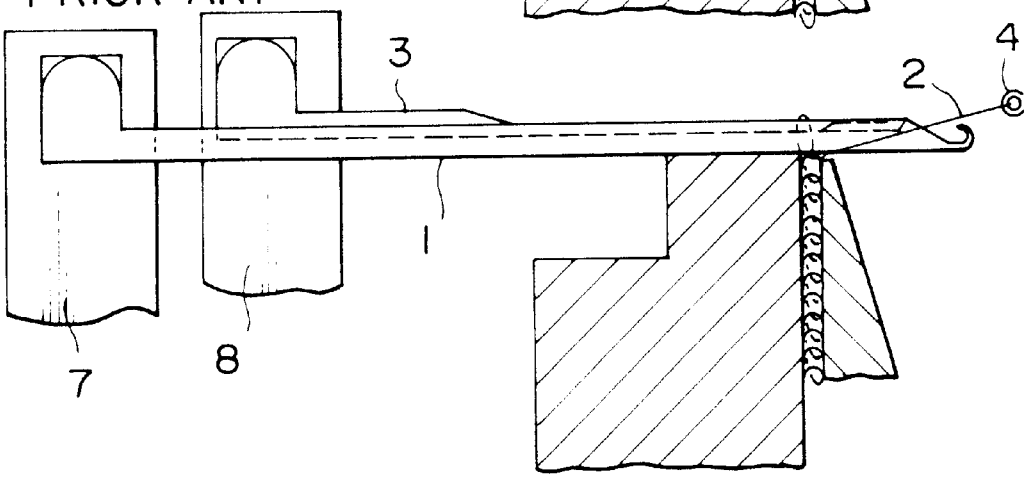
FIG. 7C PRIOR ART
Figure 7D:
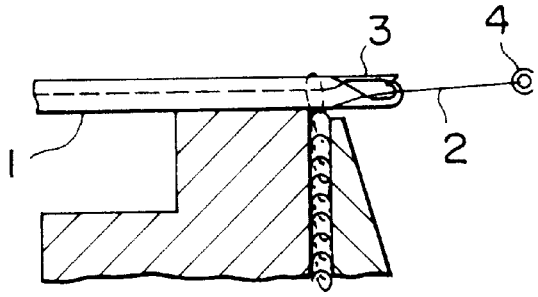
FIG. 7D PRIOR ART

FIG. 6 shows a knitting operation curve of the hook-like knitting needle 11 and the needle-like slider 12 according to the above embodiments of the present invention. In a knitting operation of the compound knitting needle 10 of the present invention shown in FIG. 6, a time when the hook opening 11*c* is closed by the slider 12 is ½ of one cycle operation, and while the hook opening 11*c* is closed, the distal end of the hook opening 11*c* fully corresponds with the distal end of the slider 12. Thus, it is possible to prevent an unnecessary knitting yarn from being inserted in the hook opening 11*c*, and to fully prevent an already formed loop from being released. Further, it is possible to suitably set a time until the hook opening 11*c* is closed by the needle-like slider 12 after being opened, that is, a time spent for inserting the necessary knitting yarn.

As described above, the operation curve of the slider 12 is suitably set with respect to the operation curve of the hook-like knitting needle 11. This is because the rotary cam structure is employed as the driving mechanism of the slider 12. So long as the follow-up of the follower is smoothly carried out, it is relatively easy to set and process a cam curve for realizing an ideal operation curve of the slider 12. In the present invention, as described above, the positive motion cam structure is used as the rotary cam structure, and no shakiness is generated even when the machine is operated at a speed higher than the conventional case; therefore, the slider 12 as a follower can be securely and smoothly follow the high speed rotation of the rotary cams 30; 32.

Moreover, in the above embodiment, the shock absorber 33 is interposed between the bearing portions 22*a*; 31*a* and the second rod 21 so as to be relatively movable, and thereby, it is possible to avoid a non-contact state of the inner and outer cam surfaces 30*a*, 30*b*; 32*a*, 32*b* with the rolling elements 22, 23 and 31 which may be caused, due to a clearance between the inner and outer cam surfaces 30*a*, 30*b* and the rolling elements 22 and 23, or a clearance between the cam groove 32*c* and the rolling element 31. Thus, even when the machine is operated at a high speed, the second rod 21 can smoothly follow the rotation of the rotary cams 30 and 32 without shakiness. Further, the shock absorber 33 serves to reduce a load by a friction applied to the inner and outer cam surfaces 30*a*, 30*b*; 32*a*, 32*b* and the second rod 21, and to prevent a wearing between members while securing a smooth operation.

As is understood from the above description, in the driving mechanism of the compound knitting needle in a narrow width crochet knitting machine according to the present invention, a crank link mechanism and a rotary cam mechanism are combined so as to make use of merits of both mechanisms. In particular, in the case of setting an operation curve of members, the rotary cam mechanism having a wide degree of freedom in design is used as a driving mechanism of the slider, and in order to solve the problem of an follow-up inaccuracy of the follower which is a demerit of the rotary cam mechanism in a high speed rotation, the positive motion cam structure is employed. Thus, it is possible to realize an ideal operation curve of the compound knitting needle, and to be sufficiently meet a high speed operation.

In the present invention, it is apparent that various changes and modifications are possible in addition to the above embodiments, and these modifications are included in a scope of the present invention as long as these are within a range of concept defined in claims of the present invention.

What is claimed is:

1. A driving mechanism of a compound knitting needle in a narrow width crochet knitting machine, comprising:

a needle bar driving mechanism having a compound knitting needle which is composed of a plurality of hook-like knitting needles reciprocating on a needle bed, and a needle-like slider which slides in a longitudinal direction on each knitting needle and opens and closes a hook opening of the knitting needle, and reciprocating a needle bar fixing and supporting base end portions of the plurality of hook-like knitting needles via a first rod at a desired timing; and a slider bar driving mechanism reciprocating a slider bar fixing and supporting base end portions of the plurality of sliders via a second rod at a desired timing, wherein said needle bar driving mechanism comprises a rotary member supported on a main rotary shaft and said first rod having one end rotatably attached to the needle bar and the other end rotatably attached onto a position which is eccentric from the rotary axis of the rotary member, and wherein said slider bar driving mechanism comprises a rotary cam supported on the main rotary shaft and said second rod having one end having a cam follower and the other end rotatably attached to the slider bar.

2. A driving mechanism of a compound knitting needle according to claim 1, wherein the rotary cam has a cam wall portion which is formed with an inner circumferential cam surface and an outer circumferential cam surface, and the cam follower comprises a pair of rolling elements which are abutted against the cam wall portion so as to hold it between these rolling elements.

3. A driving mechanism of a compound knitting needle according to claim 2, wherein at least one support member of the rolling elements has a shock absorber mechanism for absorbing a clearance between the rolling element and the inner and outer circumferential cam surfaces of the cam wall portion.

4. A driving mechanism of a compound knitting needle according to claim 1, wherein the rotary cam has a cam groove which is formed with an inner circumferential cam surface and an outer circumferential cam surface, and the cam follower comprises a single rolling element which rolls so as to be abutted against the inner and outer circumferential cam surfaces of the cam groove.

5. A driving mechanism of a compound knitting needle according to claim 4, wherein a support member of the rolling element has a shock absorber mechanism for absorbing aclearance between the rolling element and the inner and outer circumferential cam surfaces of the cam groove.

* * * * *